United States Patent [19]

Paajanen

[11] 3,999,259

[45] Dec. 28, 1976

[54] CLAMP

[76] Inventor: Erkki Paajanen, 2525 W. Golf Blvd., Bldg. 3, Apt. 124, Pompano Beach, Fla. 33064

[22] Filed: Mar. 15, 1976

[21] Appl. No.: 667,269

[52] U.S. Cl. ..... 24/252 R; 24/137 A

[51] Int. Cl.[2] ..... A44B 21/00

[58] Field of Search ..... 24/137 A, 67.5, 252 R, 24/252 CT, 252 LH, 252 CD, 252 DC, 252 CL, 252 HE, 252 HL, 252 CP, 252 BC, 252 SH, 252 GC, 252 DP, 252 TH, 252 T, 252 TC, 252 J, 252 PC, 248 SB

[56] References Cited

UNITED STATES PATENTS

| | | | |
|---|---|---|---|
| 392,394 | 11/1888 | Allderige | 24/67.5 |
| 1,538,970 | 5/1925 | Busby | 24/137 A |
| 2,686,334 | 8/1954 | Miller | 24/252 R X |
| 3,597,813 | 8/1971 | Takahashi et al. | 24/252 PC X |
| 3,756,550 | 9/1973 | Kollitz | 24/67.5 X |

*Primary Examiner*—G. V. Larkin
*Attorney, Agent, or Firm*—Harry N. Schofer

[57] ABSTRACT

A clamp having two cooperating elements, one element carrying a pair of opposed stub shafts and the other element having a pair of channeled bearings receiving the shafts. A coiled tension spring engages a first stud mounted on the stub shaft carrying element and a second stud or other part on the handle of the bearing carrying element, whereby the spring is effective to (1) urge the jaws of the clamp toward their closed position, and (2) maintain the two elements in assembled relation.

10 Claims, 10 Drawing Figures

Fig. 1
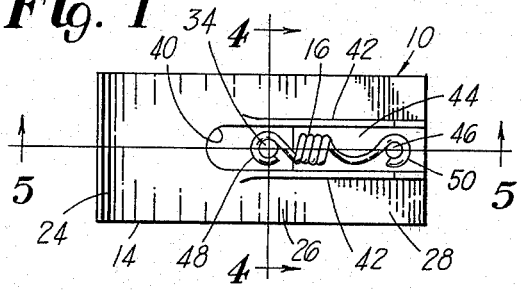
Fig. 2
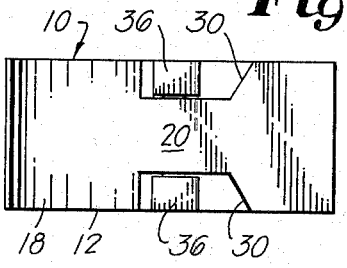
Fig. 3
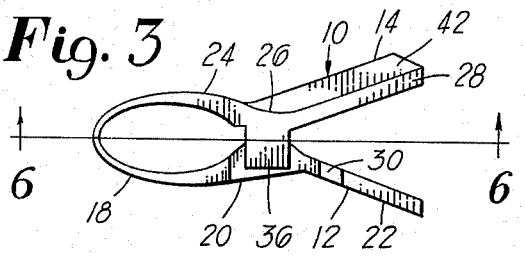
Fig. 4
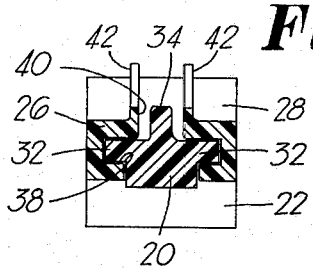
Fig. 5
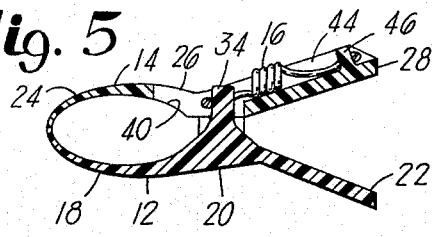
Fig. 6
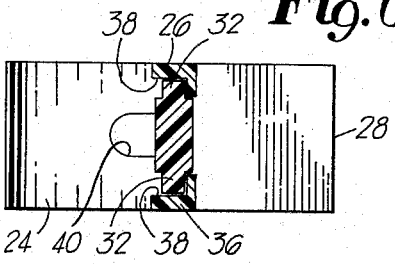
Fig. 7
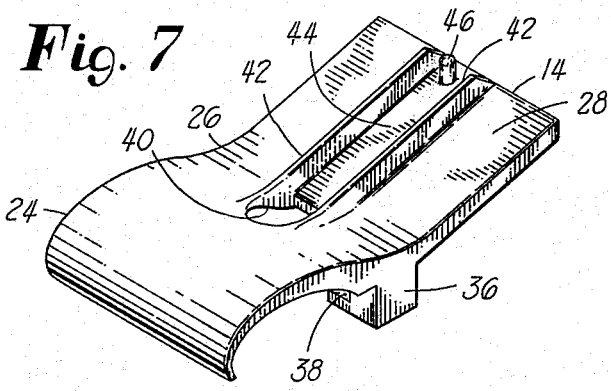
Fig. 8
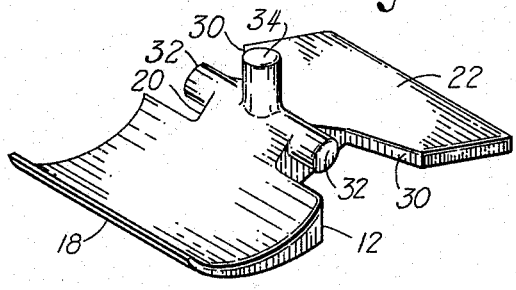
Fig. 9
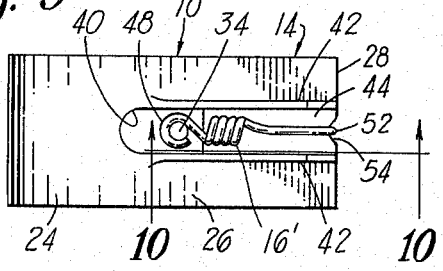
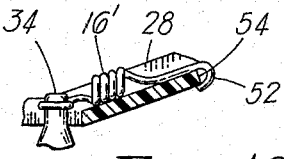
Fig. 10

CLAMP

BACKGROUND OF THE INVENTION

Field of the Invention

This invention relates to clamping devices and more particularly to a novel clamp having a minimum number of parts suitable for receiving and retaining objects between the jaws thereof.

SUMMARY OF THE INVENTION

It is an object of this invention to provide a novel clamp having a pair of cooperating elements and a tension spring, thereby providing a minimum number of parts.

It is a further object to provide a novel clamp which may be simply and inexpensively produced from plastic materials by a process of extrusion molding.

It is a still further object to provide a novel clamp in which the tension spring serves the double function of (1) urging the jaws toward their closed or contacting position, and (2) maintaining the two elongated elements in assembled relation.

It is a still further object to provide a novel clamp in which the spring attaching means is exposed on the outer part of one of the elements, thereby facilitating the connection of the tension spring to the attaching means.

The attainment of the above objects, as well as other objects and advantages is accomplished by a pair of elongated elements, each element having a jaw on one end and an operating handle on the other end. Both of said elements may be bent intermediate their ends, either by a sharp angle or by an arcuate section, and the convex areas of the bends are adapted to be brought into abutting and cooperating relation.

The intermediate portion of a first of said elements carries a pair of opposed stub shafts extending transversely of the length of the element, and an upstanding stud between said shafts. The intermediate portion of a second of said elements carries a pair of channeled members forming bearings for the stub shafts, the open ends of the channels facing forwardly or toward the jaws. Between the channeled members on the second element there is provided an aperture through which the stud extends, the stud forming a first attaching means for a tension spring. The second element has a longitudinally extrending recess in the handle thereof in which the tension spring is received, and, aligned with said recess the handle of the second element has a second attaching means for the other end of the tension spring in the form of a stud or a notch in the end of the handle.

When the two elements are assembled with the stub shafts received within the channels providing the bearings, the tension spring is attached to the two attaching or engaging means to urge the jaws into cooperating or closed position, and also to maintain the two elements in assembled relation.

BRIEF DESCRIPTION OF THE DRAWINGS

For a clearer understanding of the invention, reference is made to the annexed sheet of drawings, in which:

FIG. 1 is a top view of a preferred embodiment of the invention;

FIG. 2 is a bottom view of the embodiment shown in FIG. 1;

FIG. 3 is a side view of the embodiment shown in FIG. 1;

FIG. 4 is a transverse sectional view taken along the line 4—4 of FIG. 1;

FIG. 5 is a longitudinal sectional view taken along the line 5—5 of FIG. 1;

FIG. 6 is a sectional view taken along the line 6—6 of FIG. 3;

FIG. 7 is a perspective view of one element of the clamp shown in FIG. 1;

FIG. 8 is a perspective view of another element of the clamp shown in FIG. 1;

FIG. 9 is a top view of the clamp shown in FIG. 1 illustrating a different form of engaging means for one end of the resilient means; and FIG. 10 is a sectional view of the form of the clamp shown in FIG. 9 taken on the line 10—10 thereof.

DESCRIPTION OF A PREFERRED EMBODIMENT

Referring to the annexed sheet of drawings which illustrates a preferred embodiment of the invention, the numeral 10 designates the clamp in its entirety, comprising a first elongated element 12, a second elongated element 14, and a resilient means 16 maintaining the two elements 12 and 14 in assembled relation as will be more clearly pointed out later in this description.

As seen in FIG. 8, the first elongated element includes a jaw 18 on one end, an intermediate portion 20, and an operating handle 22 on the other end.

Referring to FIG. 7, the second elongated element 14 includes a jaw 24 on one end, an intermediate portion 26, and an operating handle 28 on the other end.

While the elements 12 and 14 are illustrated as being elongated, and generally rectangular in outline, it is obvious that they can assume other forms, for example, the distance between the end of the handle and the end of the jaw may be less than the distance transversely thereof, or the clamp could be triangular in outline, with the jaws narrower than the handle. While the elements in transverse longitudinal section are shown as being generally arcuate, it is evident that they could assume other forms, or could be straight. The jaws could also assume other forms, depending upon the purpose for which the clamp is intended.

The opposite sides of the intermediate portion 20 of the first elongated element 12 are indented as shown at 30 to give the portion a reduced section, and a pivoting means 32, in the form of a pair of stub shafts, extend from this reduced section. See FIGS. 4, 6 and 8. The intermediate portion 20 also includes a first engaging means 34, in the form of an upstanding stud, adapted to be engaged by one end of the resilient means 16, the stud being disposed intermediate the stub shafts and extending at right angles thereto. As shown, the longitudinal axes of the stub shafts 32 and the stud 34 lie in a common plane, but it is evident that the clamp will operate efficiently even if the planes were offset slightly.

Extending at right angles from the intermediate portion 26 of the second elongated element 14 is a pair of spaced bearing means 36, each bearing means including a channel 38 opening forwardly, or toward the jaws, as seen in FIGS. 6 and 7, said channels being rounded at the bases, adapted to receive the stub shafts 32.

Referring to FIGS. 1, 4, 5 and 7, the second elongated element 14 includes an aperture 40 in the intermediate portion 26 through which the stud 34 extends when the first and second elements are in assembled relation with the stub shafts 32 received within the channels 38. The operating handle end 28 also includes a pair of upstanding spaced ribs 42 forming between them an elongated recess 44 adapted to receive the resilient means 16. A second engaging means 46, in the form of a stud, is disposed in the recess 44 adjacent the outer end.

As shown in FIGS. 1 and 5, the resilient means 16 comprises a tension spring having an eye 48 on one end engaging the engaging means or stud 34, and an eye 46 on the other end, engaging the engaging means or stud 46.

In the form of the invention illustrated in FIGS. 9 and 10, the resilient means 16′ is in the form of a tension spring having an eye 48 on one end engaging the first engaging means or stud 34, and a hook 52 on the other end engaging the engaging means 54 in the form of a notch on the outer end of the handle 28.

In assembling, the elements 12 and 14 are brought into mating relating with the concave faces of the jaws facing each other as shown. The second element 14 is moved slightly to the right of the first element 12 in a position in which the depending bearing means 36 enter the indents 30 to the right hand side of the two stub shafts 32, the indents being made long enough to receive the bearing means. The element 14 is slid forwardly, permitting the stub shafts 32 to enter the forward or open end of the channels 38, the element 14 being pushed forwardly until the stub shafts 32 engage the bottom of the channels. In this position, the first engaging means or stud extends upwardly through the aperture 40. The eye 48 of the resilient means 16 engages the stud or first engaging means 34, and the eye 50 engages the second engaging means or stud 46. When so assembled, the tension of the resilient means 16 will force the stud 34 toward the right, thereby retaining the stub shafts 32 at the closed ends of the channels 38, whereby the two elements 12 and 14 are retained in assembled relation. The tensile force of the resilient means 16 also tends to rotate the first element 12 about the stub shafts 32, causing a clockwise rotation of the first element 12 and bringing the jaws 18 and 24 into contacting or closed position as shown.

The embodiment of the invention illustrated in FIGS. 9 and 10 is assembled in the same manner, except in the case of the resilient means 16′, in which the hook 52 on the outer end engages the notch 54.

Instead of a tension spring, as shown, it is evident that the same results could be obtained if a compression spring were used engaging the stud 34 on one end and an engaging means on the outer surface of the jaw 24 in an obvious manner. It is also evident, if it were desired that the resilient means force open, instead of forcing closed, the jaws of the clamp, that the resilient means would take the form of a compression spring engaging the studs 34 and 36. In such a modification, it is evident that the channels 38 open toward the handle ends of the clamp.

While it is evident that the elements of the clamp can be made from various materials, it is preferred to make them from plastic materials. The particular shape of the elements disclosed can easily be made by a process of injection molding, whereby they can be quickly and economically manufactured.

I claim:

1. A clamp, comprising: a first element having a jaw on one end, an operating handle at the other end, a pivoting means and a first engaging means intermediate the ends; a second element having a jaw at one end, an operating handle at the other end, a bearing means and an aperture intermediate the ends, said first engaging means extending through said aperture when said pivoting means are received in said bearing means; said second element having a second engaging means; and a resilient means engaging said first engaging means and said second engaging means to maintain said jaws in closed relation.

2. A clamp as defined in claim 1, in which said first engaging means comprises a stud.

3. A clamp as defined in claim 2, in which said resilient means comprises a tension spring.

4. A clamp as defined in claim 3, in which said second engaging means comprises a stud in the handle of said second element.

5. A clamp as defined in claim 3, in which said second engaging means comprises a notch in the handle end of said second element.

6. A clamp as defined in claim 1, in which said bearing means includes at least one channel, the open end of which faces toward the jaws to receive said pivoting means, whereby said resilient means retains the elements in assembled relation.

7. A clamp as defined in claim 6, in which said pivoting means includes a pair of opposed stub shafts, and in which said bearing means comprises a pair of spaced members having said channels receiving said shafts.

8. A clamp as defined in claim 7, in which said first element has a portion of reduced width intermediate its ends carrying said opposed stub shafts, said reduced portion fitting within said spaced members carried by said second element.

9. A clamp as defined in claim 8, in which said stub shafts and said first engaging means are aligned transversely of the clamp.

10. A clamp as defined in claim 9, in which the outer side of the handle of the second element includes a longitudinally extending recess in alignment with said first and said second engaging means, said resilient means being received within said recess.

* * * * *